US010589976B2

(12) United States Patent
Krulitsch

(10) Patent No.: US 10,589,976 B2
(45) Date of Patent: Mar. 17, 2020

(54) FILLING SYSTEM FOR FILING PACKAGES

(71) Applicant: KHS GmbH, Dortmund (DE)

(72) Inventor: Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 302 days.

(21) Appl. No.: 15/736,056

(22) PCT Filed: Jun. 13, 2016

(86) PCT No.: PCT/EP2016/063458
§ 371 (c)(1),
(2) Date: Dec. 13, 2017

(87) PCT Pub. No.: WO2016/207006
PCT Pub. Date: Dec. 29, 2016

(65) Prior Publication Data

US 2018/0170741 A1 Jun. 21, 2018

(30) Foreign Application Priority Data

Jun. 23, 2015 (DE) ..... 10 2015 110 067

(51) Int. Cl.
*B67C 3/26* (2006.01)
*B67C 3/28* (2006.01)
*B65B 3/26* (2006.01)

(52) U.S. Cl.
CPC ..... *B67C 3/286* (2013.01); *B65B 3/26* (2013.01); *B67C 3/26* (2013.01)

(58) Field of Classification Search
CPC .. B67C 3/286; B67C 3/26; B67C 3/00; B67C 3/02; B67C 3/22; B67C 3/2617; B67C 3/28; B65B 3/04; B65B 3/29
See application file for complete search history.

(56) References Cited

U.S. PATENT DOCUMENTS

| | | | | |
|---|---|---|---|---|
| 3,037,536 | A * | 6/1962 | Fechheimer | B67C 3/16 141/7 |
| 4,434,821 | A * | 3/1984 | Bacroix | B67C 3/2634 141/301 |
| 5,016,684 | A * | 5/1991 | Clusserath | B67C 3/06 141/39 |
| 5,150,743 | A * | 9/1992 | Walusiak | B67C 3/28 141/144 |
| 9,126,223 | B2 * | 9/2015 | Lanier | B05B 15/5225 |
| 10,259,697 | B2 * | 4/2019 | Clusserath | B67C 3/206 |
| 2007/0006939 | A1 * | 1/2007 | Clusserath | B67C 3/12 141/40 |

(Continued)

FOREIGN PATENT DOCUMENTS

| | | |
|---|---|---|
| DE | 696 01 471 | 8/1999 |
| DE | 10 2008 064 318 | 7/2010 |
| DE | 10 2012 211 926 | 1/2014 |

(Continued)

*Primary Examiner* — Nicolas A Arnett
(74) *Attorney, Agent, or Firm* — Occhiuti & Rohlicek LLP

(57) ABSTRACT

A filling element for container filling includes a liquid-valve arrangement disposed in a liquid channel with its flow valve. A positioning drive regulates opening and closing of the flow valve so as to regulate flow of liquid through the liquid channel. A stop valve lies in the liquid channel between the flow valve and a dispensing opening.

20 Claims, 6 Drawing Sheets

(56) References Cited

U.S. PATENT DOCUMENTS

| | | | | |
|---|---|---|---|---|
| 2009/0166386 | A1* | 7/2009 | Morand | B67C 3/281<br>222/559 |
| 2013/0112719 | A1 | 5/2013 | Huitorel | |

FOREIGN PATENT DOCUMENTS

| | | | | |
|---|---|---|---|---|
| DE | 10 2012 21192 | | 1/2014 | |
| DE | 10 2012 211926 | | 1/2014 | |
| DE | 10 2013 106 927 | | 1/2015 | |
| DE | 10 2013 10692 | | 1/2015 | |
| DE | 10 2013 106927 | | 1/2015 | |
| EP | 2 141 115 | | 1/2010 | |
| GB | 871378 | A * | 6/1961 | F16K 31/128 |
| WO | WO-2008126119 | A1 * | 10/2008 | B67C 3/007 |

* cited by examiner

FILLING SYSTEM FOR FILING PACKAGES

RELATED APPLICATIONS

Under 35 USC 371, this is the U.S. national stage of international application PCT/EP2016/063458, filed on Jun. 13, 2016, which claims the benefit of the Jun. 23, 2015 priority date of German application DE 10-2015-110-067.3, the content of which are herein incorporated by reference.

FIELD OF INVENTION

The invention relates to filling machines, and in particular, to filling elements for filling containers with a liquid filling-product.

BACKGROUND

Filling elements usually have a valve in which some valve element moves to open and close the valve. This valve element must often move against a force that results from the filling pressure. Overcoming this force uses up energy. This is undesirable.

SUMMARY

It is an object of the invention to disclose a filling element for controlling or regulating the volumetric flow of the liquid content during the filling phase with reduced control forces needed for opening, adjusting, and closing the flow valve of a filling element. These filling elements are preferably configured so that the operating forces for opening, adjusting and closing the respective flow valve of a filling element are not affected by the action of the pressure of the liquid content.

With the filling element, the controlled dispensing of the liquid content into the container is effected by a liquid valve arrangement that comprises at least one flow valve and one stop valve that succeed one another sequentially and in the direction of flow of the liquid content during filling, with the stop valve being preferably configured as a pure stop valve only controllable between an opened and a closed state.

The stop valve is a liquid valve that, in the filling phase, does not perform any regulating of the volumetric flow. Its sole function is that of starting and stopping the flow. The volumetric flow is easily regulated and/or controlled between a minimum value and a maximum value with the flow valve.

Because the separate stop valve is provided for opening and closing the filling element, the same or essentially the same pressure is present on both sides of the flow valve even when it is closed. The force needed to close or open the flow valve will therefore no longer depend on the pressure of the liquid content. When the flow valve is controlled by an electric positioning drive, and in particular by an electromagnetic positioning drive, this means that only a greatly reduced amount of current is needed to close the flow valve and keep it closed and/or to open said valve and keep it open. This is very important in regard to the design of the positioning drive and of its electrical supply, especially for rotary-type filling systems or filling machines where the filling elements are provided on a rotor that rotates about a vertical machine axis and on which only a limited amount of electrical power is available and in particular where it is extremely problematic to dissipate the waste heat from a positioning drive that has to be driven at high power.

For the purpose of the invention, 'containers' are in particular cans, bottles, tubes, and pouches, made from metal, glass and/or plastic, and other packages suitable for filling liquid or viscous products.

For the purpose of the invention, "open jet filling" is understood to be a method in which the liquid content flow in an open filling jet to the container to be filled, and on its way into the container the jet of liquid content is not influenced by additional elements such as for example swirl bodies, gas barriers etc. The container's mouth or opening can lie in sealed contact against the filling element or alternatively can be at a distance away from it.

For the purpose of the invention the expressions "substantially" or "around" mean variations from the respective exact value by ±10%, preferably by ±5% and/or variations in the form of changes insignificant for the function.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE DRAWINGS

The invention is explained in detail below through the use of embodiment examples with reference to the figures. In the figures.

DETAILED DESCRIPTION

Figure 1:
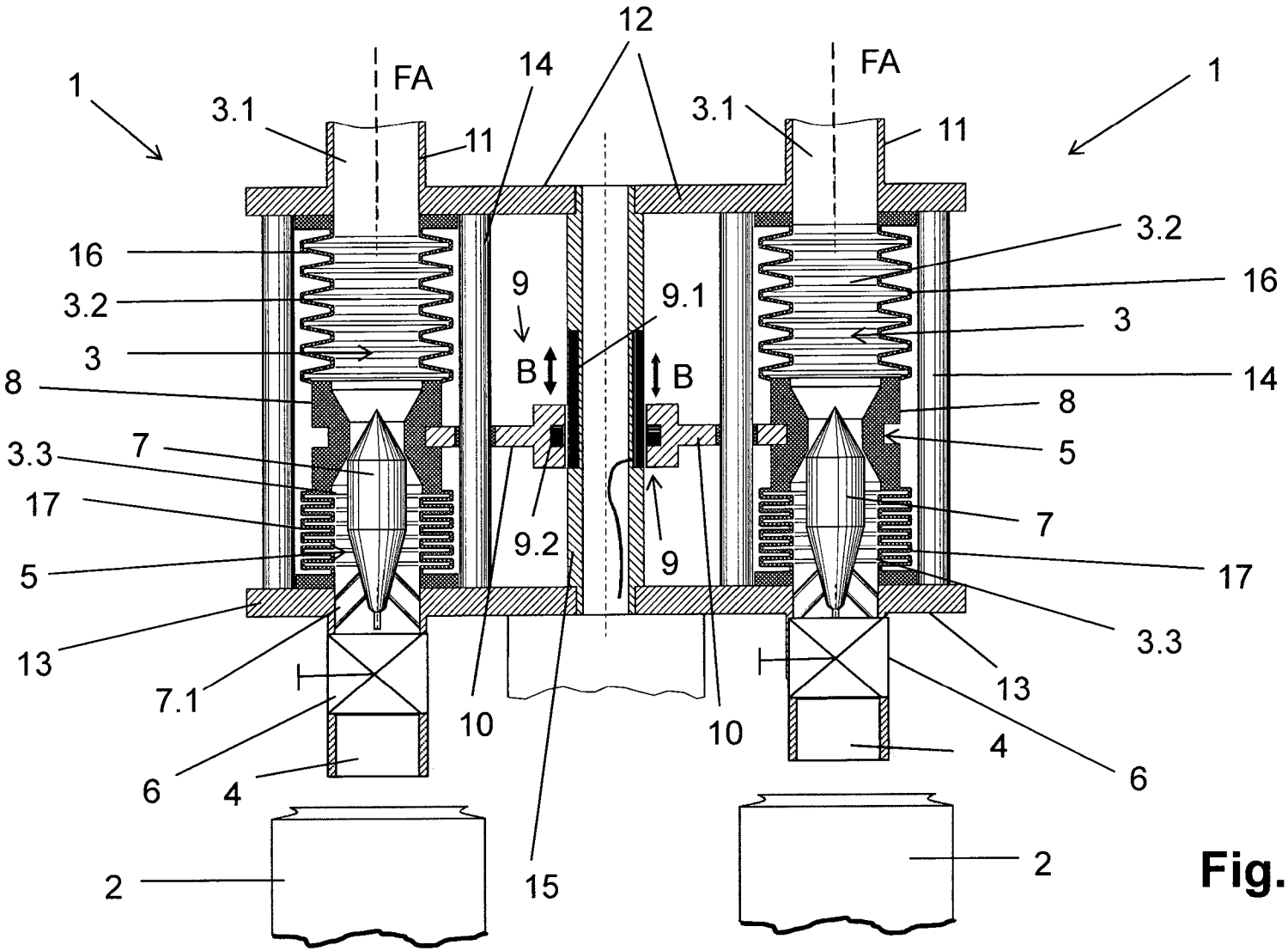
FIG. 1 shows a pair of filling elements that are closed.
Figure 2:
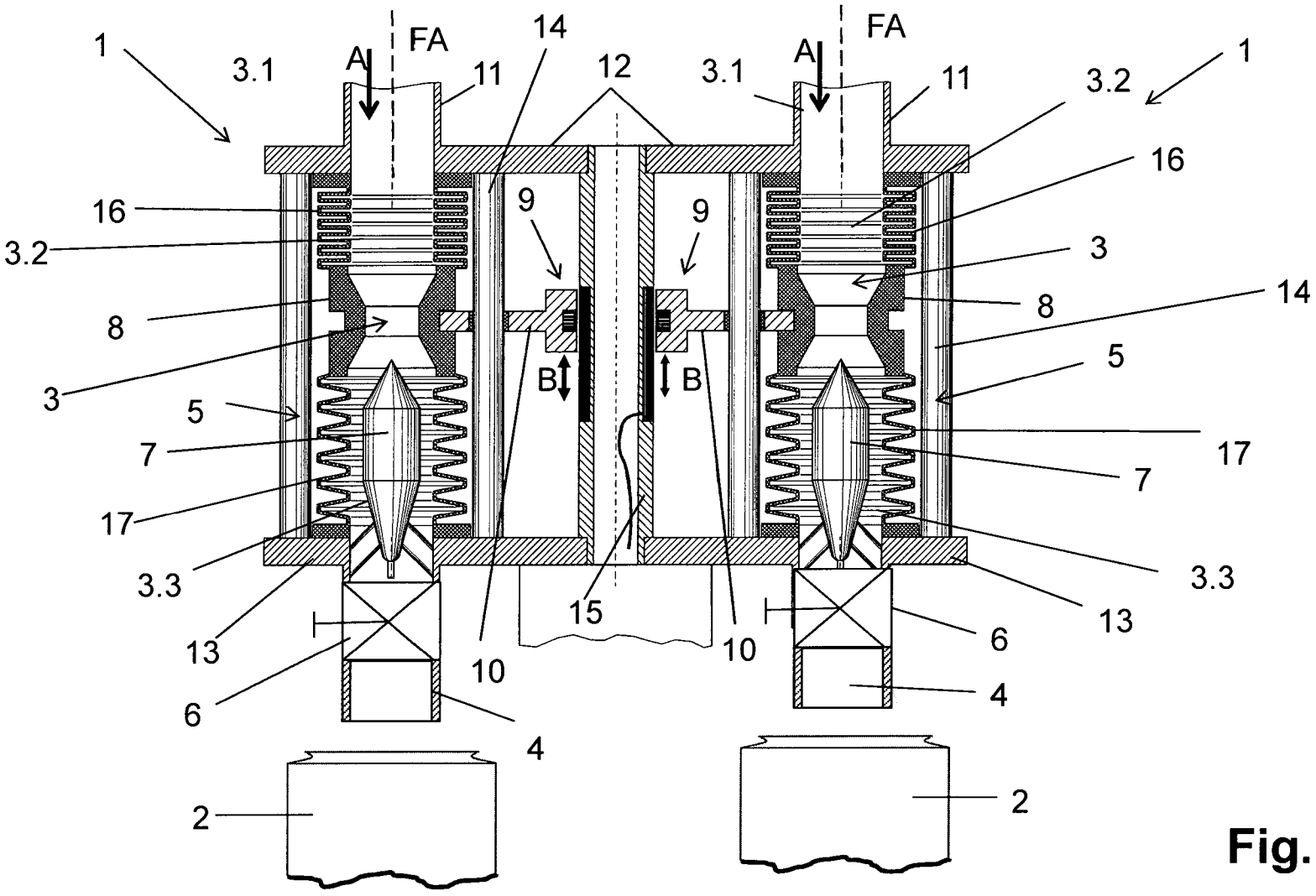
FIG. 2 shows the pair of FIG. 1, but opened.

FIGS. 1 and 2 each show a pair of identically configured filling elements 1 for the controlled filling of containers 2 with a liquid product. In the illustrated embodiment, the containers 2 happen to be cans. But the containers can also be bottles or any other package suitable for receiving the liquid product.

The pair of filling elements 1 is one of many identical pairs that are part of a filling machine. In the case of a rotary filling machine, the pairs are mounted around the periphery of a rotor that is drive to rotate about a vertical machine-axis. The filling elements are configured for open-jet filling of containers 2. However, they can also be adapted to other filling methods.

Referring now to FIG. 1, each filling element 1 has a liquid channel 3 through which the liquid product flows from a tank in the flow direction A, as shown in FIG. 2. The liquid channel 3 ends in a dispensing opening 4 through which the liquid product flows into a container 2 located under the filling element 1. A connector 3.1 at the upper end of the liquid channel 3 connects the liquid channel 3 to the tank. A flow valve 5 in the liquid channel 3 between the connector 3.1 and the dispensing opening 4 regulates the flow rate of the liquid product into the container 2. Between the flow valve 5 and the dispensing opening 4 is a stop valve 6.

The flow valve 5 includes a valve body 7 that is arranged in the liquid channel 3 coaxially with an axis FA that can be viewed as a valve axis or lifting axis that corresponds to a filling element axis. The valve body 7 interacts with an annular valve seat 8 formed by an annular body. When the flow valve 5 closes, the valve body 7 and the valve seat 8 lie against each other as shown in FIG. 1. When the flow valve 5 opens, a gap separates the valve body 7 and the valve seat 8.

In the illustrated embodiment, the valve body 7 is fixed. It does not move axially in the liquid channel 3. A positioning drive 9 moves the valve seat 8 axially along the axis FA relative to the valve body 7 along a movement direction B shown in both FIGS. 1 and 2. In the illustrated embodiment, the positioning drive 9 is an electromagnetic drive or linear drive connected to the valve seat 8 by a driving stem 10. To regulate flow, the positioning drive 9 lifts the valve seat 8 against the flow direction A.

The positioning drive 9 includes a stator 9.1 and a rotor 9.2. The stator 9.1 includes a stator coil and magnetic poles positioned one after the other parallel to the axis FA. These interact across a magnetic gap with the rotor 9.2, which is provided on the driving stem 10 and which has a permanent magnet thereon. The magnetic gap that separates the stator 9.1 and the rotor 9.2 is to the side of the valve seat 8 and outside the liquid channel 3.

A filling element 1 includes an upper housing part 12 and a lower housing part 13. Vertical bars 14 separate the upper and lower housing parts 12, 13 along the axis FA. Within the upper housing part 12, a tube 11 forms the connector 3.1. The lower housing part 13 includes a lower section of the liquid channel 3 that surrounds the valve body 7. Ribs 7.1 extending from the wall of the liquid channel 3 suspend the valve body 7 at the lower housing part 13.

The driving stem 10 is mounted on one of the vertical bars 14 so as to be axially displaceable parallel to the axis FA. A plate 15 holds the stator 9.1 of the positioning drive 9. The plate 15 extends between the upper and lower housing parts 12, 13 to which it is attached. In addition to moving axially along the vertical bars 14, the driving stem 10 also forms an axial guide for the valve seat 8. Although it is possible for the driving stem 10 to engage only one vertical bar 14, having the driving stem 10 engage two or more vertical bars 14 prevents unwanted swinging or twisting and ensures accurate guiding of the valve seat 8 along the axis FA.

The liquid channel 3 includes upper and lower sealed sections 3.2, 3.3 that lie upstream and downstream of the valve 5 respectively. A first flexible seal 16 extends between the connector 3.1 and the valve seat 8 to define the upper sealed section 3,2. The second flexible seal 17 extends between the valve seat 8 and the lower housing part 13 to define the lower sealed section 3.2. In the illustrated embodiment, bellows form each of the first and second flexible seals 16, 17.

Before the start of a filling process, the stop valve 6 and the flow valve 5 are closed. The stop valve 6 seals off the liquid channel 3, even though liquid content that are at a filling pressure have been fed to the filling element 1. This substantially equalizes the pressure in the upper and lower sealed sections 3.2, 3.3.

Filling begins by at least partially opening the flow valve 5. This is carried out by having the positioning drive 9 lift the valve seat 8 off the valve body 7 in a controlled manner. Because the pressures in the upper and lower sealed sections 3.2, 3.3 have been equalized, it is possible to carry out this lifting with very little force. This reduces the electric current needed to operate the positioning drive 9.

It is only after both the flow valve 5 and the stop valve 6 have opened that the liquid content flow through the dispensing opening 4 and into the container 2. During this filling phase, the positioning drive 9 controls the volumetric flow rate by controlling the flow valve 5. As a result, it is possible to have a reduced flow rate at the beginning or end of the filling phase by reducing the opening cross-section of the flow valve 5.

At the end of the filling phase, the stop valve 6 closes before the flow valve 5. It does so in response to a signal from a sensor element or measuring element that determines the fill quantity, the fill weight, and/or the fill height in the container 2. Suitable sensors include a flow meter, a weighing scale, and a probe that reaches into the container 2.

The positioning drive 9 closes the flow valve 5 by moving the valve seat 8 so that it engages the valve body 7. This is carried out in a time-controlled manner, for example, after lapse of some interval.

In some practices, this procedure is reversed. In such practices, the filling phase ends when the sensor element sends a signal that actuates the positioning drive 9 so that the positioning drive 9 closes the flow valve 5. The stop valve 6 is then closed in a time-controlled manner, for example, after lapse of some interval.

Figure 4:
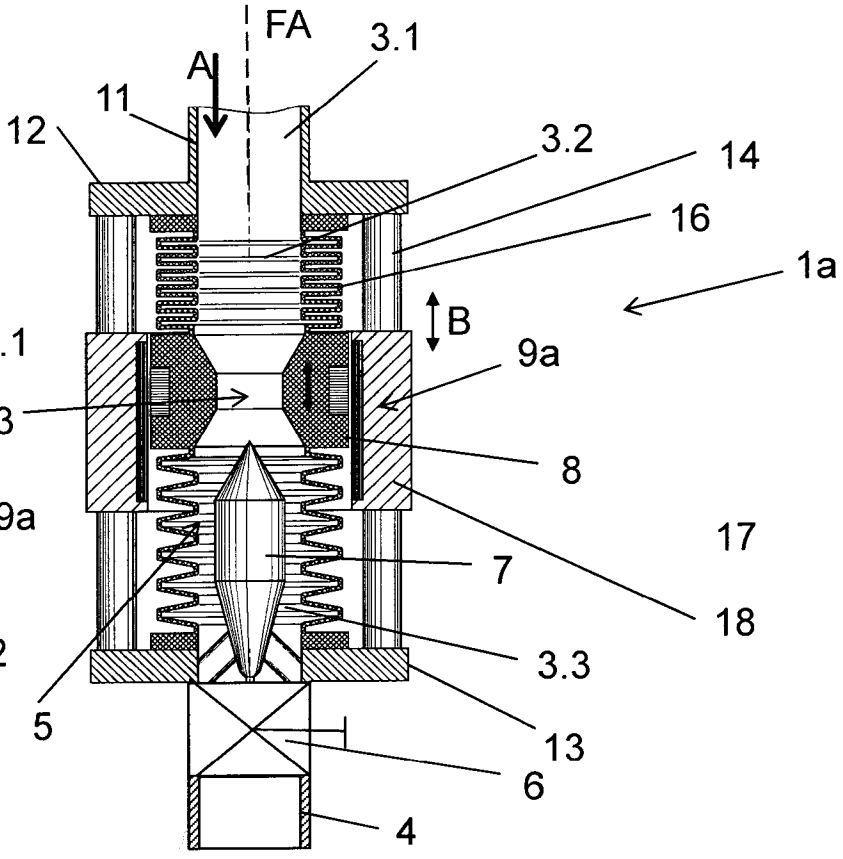
FIG. 4 shows the pair of FIG. 3, but opened.
Figure 3:
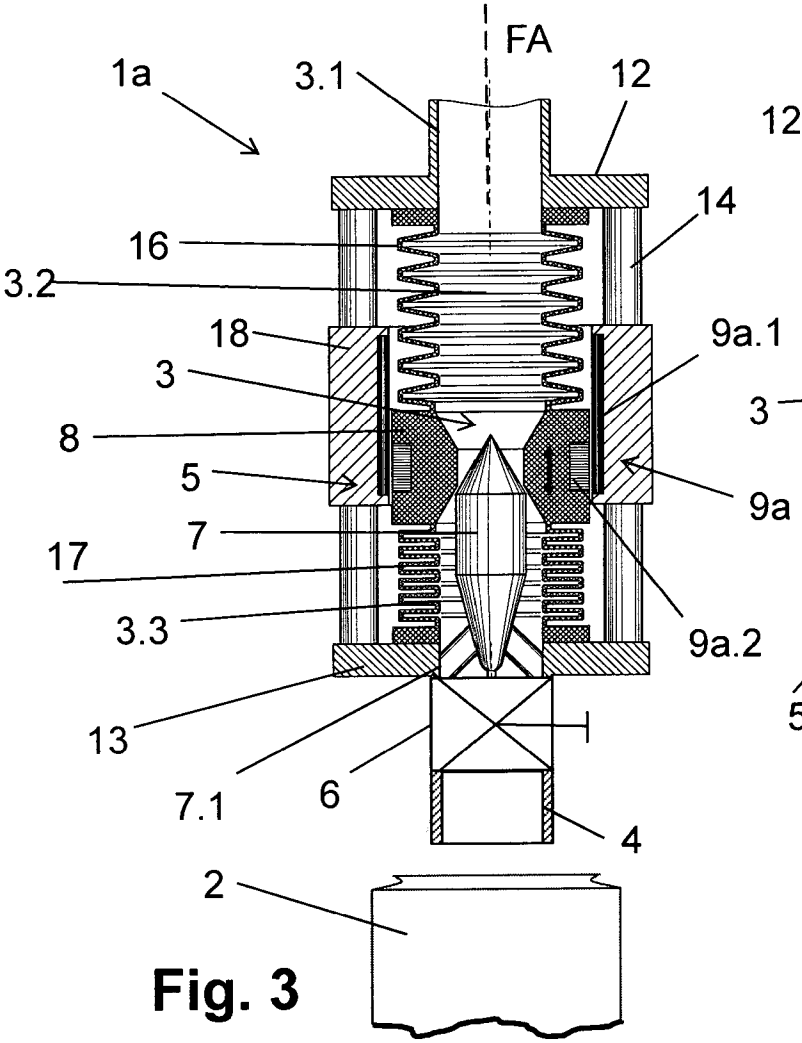
FIG. 3 shows another pair of filling elements that are closed.

FIGS. 3 and 4 show a further embodiment of a filling element 1*a* in which a positioning drive 9*a* has a stator 9*a*.1 and a rotor 9*a*.2. In this embodiment, the arrangement of the stator 9*a*.1 and the rotor 9*a*.2 dispense with the need for a driving stem 10.

The stator 9*a*.1 has a stator coil that is coaxial with the axis FA. The coil surrounds the valve seat 8 on a preferably circular-cylindrical peripheral surface thereof. The stator 9*a*.1 is provided on the inner face of a ring-shaped middle housing part 18 between the upper and lower housing parts 12, 13. Vertical bars 14 support the middle housing part 18. The middle housing part 18 thus surrounds the valve seat 8 over at least part of its length and, together with the stator 9*a*.1, forms an axial guide for the valve seat 8.

The rotor 9*a*.2 includes a permanent-magnet array disposed on an outer face of the valve seat 8. As a result the magnetic gap between the stator 9*a*.1 and the rotor 9*a*.2 is again outside the liquid channel 3.

The way in which the filling element 1*a* operates is identical with the operation described above for filling element 1. However, in this alternative filling element 1*a*, the driving stem 10 is no longer needed because of the configuration of the stator 9*a*.1 and the rotor 9*a*.2.

Figure 5:
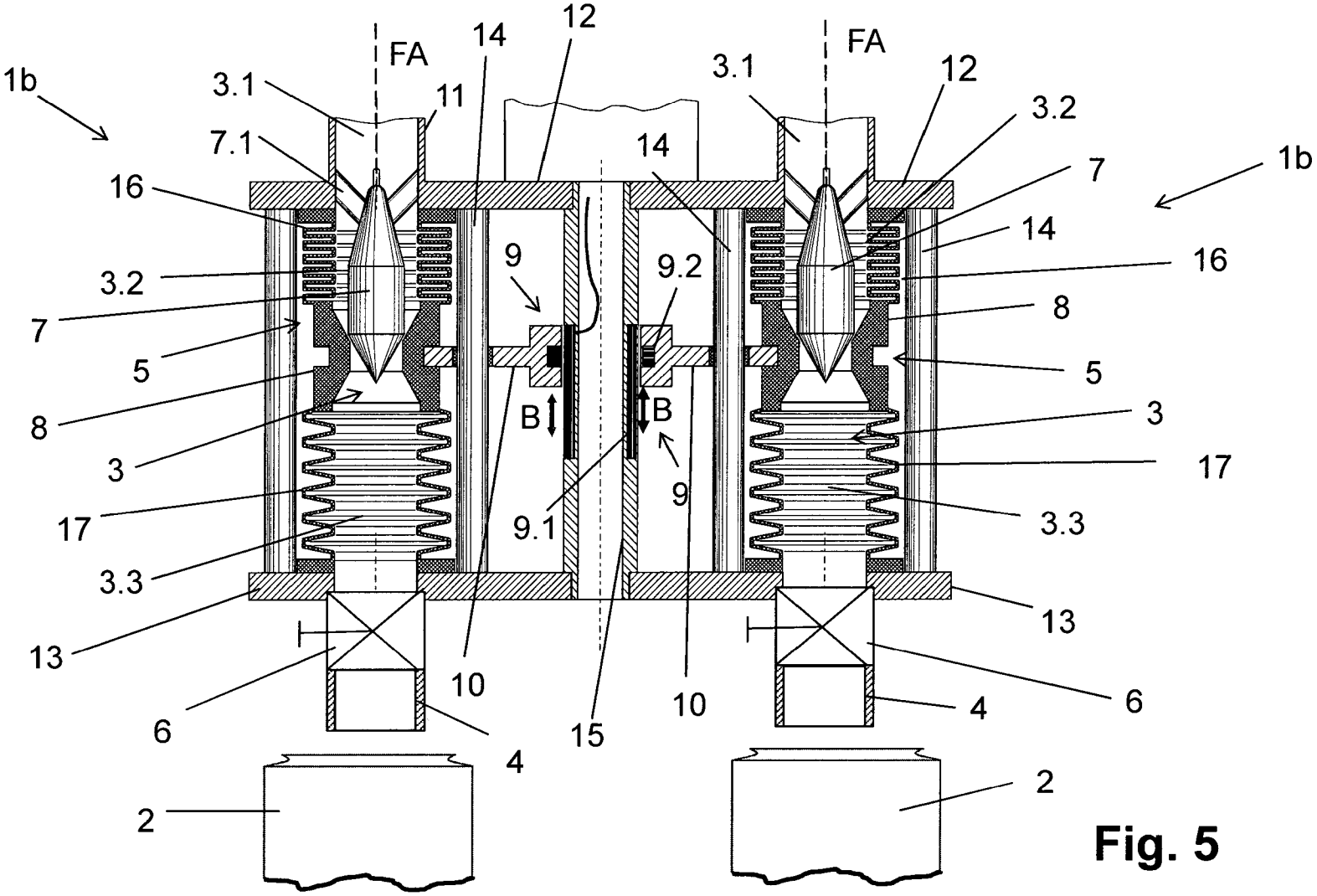
FIGS. 5 and 6 show another pair of filling elements in the closed and opened position.
Figure 6:
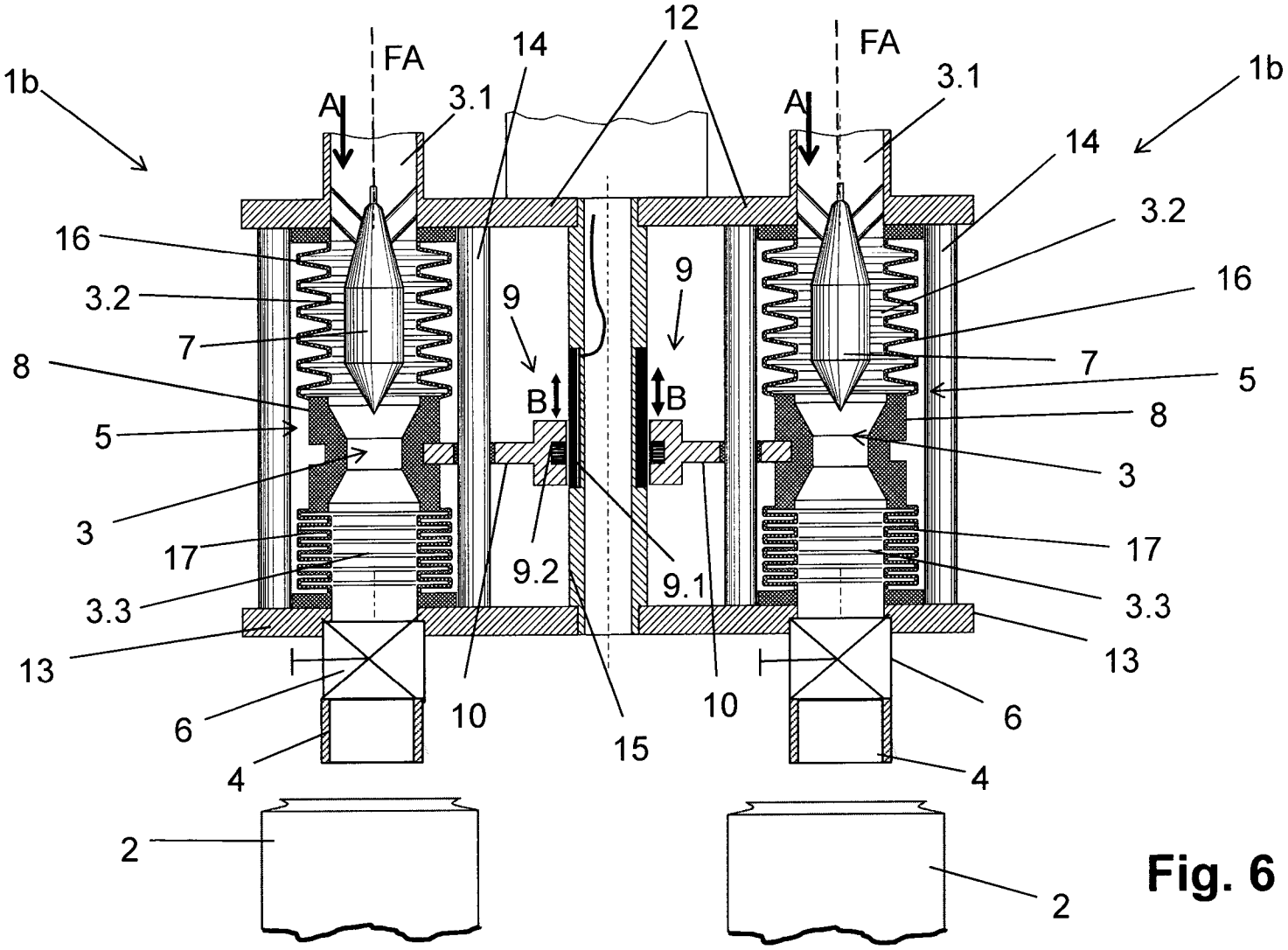

FIGS. 5 and 6 show another pair of filling elements 1*b*. In FIG. 5, the filling elements 1*b* are closed and in FIG. 6 they are open. In this alternative embodiment, the positioning drive 9 lowers the valve seat 8 in the flow direction A to open the flow valve 5. It does so by moving the valve body 7 toward the dispensing opening 4. Raising the valve seat 8 against the flow direction A closes the flow valve 5. The valve body 7, which is held by ribs 7.1 on the upper housing part 12, is at least partly disposed inside the upper sealed section 3.2 of the liquid channel 3 for this purpose.

The filling element 1*b* is used in such a way that, at the beginning of the filling process and when a container 2 has been positioned under the filling element 1*b*, the flow valve 5 is closed by the valve seat 8 lying against the valve body 7 and the stop valve 6 is also closed. To initiate the filling phase, the flow valve 5 and the stop valve 6 open, either at the same time or in sequence, for example by opening the flow valve 5 and subsequently opening the stop valve 6 or vice versa. During the filling phase, the volumetric flow of the liquid content flowing to the container 2 can again be regulated with the flow valve 5 by appropriately actuating the positioning drive 9.

Closing the stop valve 6 terminates the filling phase. Subsequently, the positioning drive 9 returns the flow valve 5 to its closed position.

In some practices, the flow valve 5 stays at least partially open after the end of the filling phase, i.e. after the closing the stop valve 6, so as to prepare a further subsequent filling phase.

One advantage of the filling element 1*b* is that when the stop valve 6 is open, the opening of the flow valve 5 is assisted by the liquid content flowing through the liquid channel 3 and/or by the filling material's pressure. Another advantage is that closing the filling element 1*b* and keeping it closed is effected not by the flow valve 5 but by the stop valve 6, if necessary only assisted by the flow valve 5. As a result, when the filling element 1*b* is closed, the positioning drive 9 requires no control current or only a very reduced control current.

Figure 8:
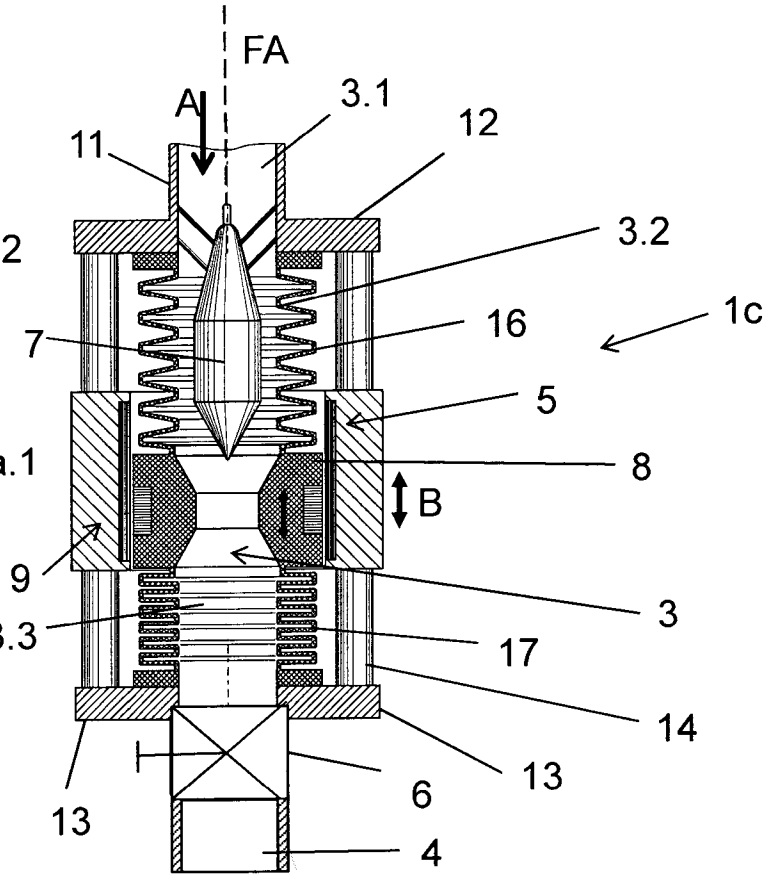
FIGS. 7 and 8 show another pair of filling elements in the closed and opened position.
Figure 7:
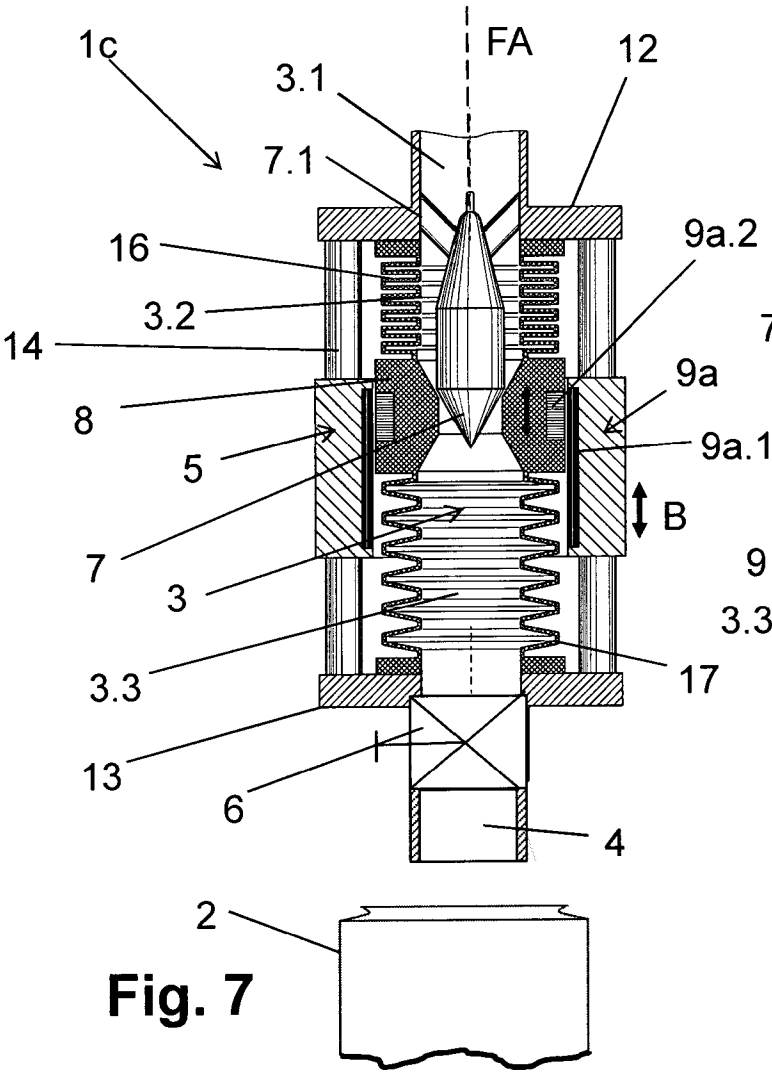

FIG. 7 shows a filling element 1*c* in its closed state. The same filling element 1*c* is shown open in FIG. 8.

The filling element 1*c* includes a different positioning drive 9*a*. The positioning drive 9*a* includes a stator 9*a*.1 and a rotor 9*a*.2. The stator 9*a*.1 is annular and coaxial with the axis FA. The rotor 9*a*.2 includes a permanent magnet array on a circular-cylindrical outer face of the valve seat 8. The function of the filling element 1*c* corresponds to that of the filling element 1*b*.

It is of particular advantage if the filling element 1 is configured so that the operating forces needed for opening, adjusting, and closing the flow valve 5 are not affected by the pressure of the liquid content.

The various embodiments described herein feature a liquid channel 3 having a liquid-valve arrangement that has at least one flow valve 5 and a stop valve 6 that is downstream of the flow valve 5. The flow valve 6 includes a valve body 7 and a valve seat 8. The liquid channel includes an upper sealed section 3.2 and a lower sealed section 3.3 that are flexible or deformable. Useful implementations of the upper and lower sealed sections 3.2, 3.3 include, in addition to bellows, a membrane or a roller membrane.

The respective outer and/or inner dimensions of the bellows that form the upper sealed section 3.2 of the liquid channel 3 and the corresponding dimensions of the bellows that form the lower sealed section 3.3 of the liquid channel 3 are selected so that the sum of the effects of the pressure of the liquid content and/or the sum of the effects of the flow of the liquid content on both upper and lower sealed sections 3.2, 3.3 of the liquid channel 3 is zero or substantially zero.

The pressing force generated by the pressure of the liquid content will be determined by the effective diameter of the bellows. The effective diameter of a bellows, which determines the force that results from the pressure of the liquid content and that acts in the direction of the main axis of the valve seat 8 of the flow valve 5, depends on the root of $((d_i^2+d_o^2)/2)$, where $d_i$ and $d_o$ are the inner and outer diameters of the bellows, respectively.

By an appropriate choice of the effective bellows diameter, it is possible to cancel the forces acting in the direction of the valve seat 8 of the flow valve 5 in the upper and lower sealed sections 3.2, 3.3 of the liquid channel 3 as a result of the pressure of the liquid content. As a result, the force resulting from the pressure of the liquid content places no load or no substantial load on the valve seat 8 of the flow valve 5. This yields a significant reduction in the necessary operating forces of the flow valve.

The invention has been described herein by reference to one embodiment. However, numerous variations and modifications are possible. For example, instead of the positioning drives 9, 9*a* being electromagnetic drives, other electric positioning drives are possible. These include servo-motors and stepper motors. Alternatively, it is possible to use a mechanical controller to control the axial motion of the valve seat 8, for example by using a roller that interacts with a cam track.

The invention claimed is:

1. An apparatus for controlled dispensing of liquid content into containers, said apparatus comprising a filling element, wherein said filling element comprises a stop valve, a flow valve, a dispensing opening, a liquid channel, a liquid-valve arrangement, and a positioning drive, wherein said liquid-valve arrangement is disposed in said liquid channel, wherein said liquid-valve arrangement is controllable to transition between open and closed states, wherein, in said open state, said liquid-valve arrangement permits flow of liquid content through said liquid channel and out through said dispensing opening, wherein, in said closed state, said liquid-valve arrangement blocks such flow, wherein said liquid-valve arrangement comprises said flow valve, said positioning drive, and said stop valve, wherein said positioning drive regulates opening and closing of said flow valve so as to regulate flow of liquid through said liquid channel between a minimum value and a maximum value, wherein said stop valve transitions between an open state and a closed state, and wherein said stop valve is disposed in said liquid channel between said flow valve and said dispensing opening.

2. The apparatus of claim 1, wherein said flow valve comprises a valve body and a valve seat, wherein said valve body is arranged in said liquid channel, wherein said valve seat engages said valve body when said valve is closed, wherein an annular body forms said valve seat, and wherein said positioning drive causes relative motion between said valve body and said valve seat along a valve axis.

3. The apparatus of claim 1, wherein said flow valve comprises a valve body and a valve seat and wherein said valve seat is movable by said positioning drive against a flow direction of said liquid through said liquid channel.

4. The apparatus of claim 1, wherein said liquid content flows through said liquid channel along a flow direction, wherein said flow valve comprises a valve body and a valve seat, and wherein said valve seat is configured to be moved along said flow direction by said positioning drive.

5. The apparatus of claim 1, wherein said flow valve comprises a valve seat, wherein said liquid channel comprises first and second bellows, wherein said first bellows define an upper sealed section and said second bellows define a lower sealed section, wherein said upper and lower sealed sections have variable lengths, wherein said liquid content flows through said liquid channel along a flow direction, and wherein, relative to said flow direction, said upper sealed section is upstream of said valve seat and said lower sealed section is downstream of said valve seat.

6. The apparatus of claim 1, wherein said flow valve comprises a movable valve seat and wherein said liquid-valve arrangement further comprises an axial guide for guiding movement of said valve seat.

7. The apparatus of claim 1, further comprising a housing having a housing part, said housing part being configured to provide guidance for axial movement of an axially movable valve seat of said flow valve.

8. The apparatus of claim 1, wherein said liquid-valve arrangement comprises vertical bars that connect upper and lower housing parts thereof and that provide guidance for vertical movement of an axially movable valve seat of said flow valve.

9. The apparatus of claim 1, wherein said positioning drive comprises an electromagnetic linear drive.

10. The apparatus of claim 1, wherein said positioning drive comprises a servo-motor.

11. The apparatus of claim 1, wherein said positioning drive comprises a stepper motor.

12. The apparatus of claim 1, wherein said positioning drive comprises a roller that interacts with a cam track.

13. The apparatus of claim 1, wherein said positioning drive comprises a stator and a rotor that interact across a gap, wherein said gap is outside said liquid channel.

14. The apparatus of claim 1, further comprising a driving stem, wherein said driving stem projects laterally away from an outer face of a movable valve seat of said flow valve, and wherein said positioning drive uses said driving stem to move said valve seat to open and close said flow valve.

15. The apparatus of claim 1, wherein said positioning drive comprises a permanent magnet and a plurality of coils that form magnetic poles offset along an axis of said valve arrangement and wherein said coils interact magnetically with said permanent magnet to actuate said positioning drive.

16. The apparatus of claim 1, wherein said positioning drive comprises a drive stem, a first drive element, and a second drive element, wherein magnetic interaction between said first and second drive elements causes movement of said positioning drive, wherein said drive stem projects laterally away from a valve seat of said flow valve, and wherein said second drive element connects to said driving stem.

17. The apparatus of claim 1, wherein said flow valve comprises a valve seat that selectively engages a valve body, wherein said positioning drive comprises a first drive element and a second drive element, wherein magnetic interaction between said first and second drive elements causes movement of said positioning drive, and wherein said second drive element connects to said valve seat.

18. The apparatus of claim 1, wherein said filling element is one of a pair of filling elements that are controlled together by said positioning drive.

19. The apparatus of claim 1, wherein said flow valve comprises a valve seat, wherein said liquid-valve arrangement comprises variable-length upper and lower sealed sections disposed upstream and downstream respectively from said valve seat, said upper and lower sealed sections having dimensions selected to cause a sum of pressure effects of said liquid content to approach zero.

20. The apparatus of claim 1, wherein said liquid-valve arrangement comprises first and second bellows that define corresponding upper and lower sealed sections of said liquid channel, said bellows having effective diameters such that forces acting on said upper and lower sealed sections cancel each other and such that force resulting from pressure of said liquid content places substantially no load on a valve seat of said flow valve.

* * * * *